US009435328B2

(12) United States Patent
Gerlach

(10) Patent No.: US 9,435,328 B2
(45) Date of Patent: Sep. 6, 2016

(54) VARIABLE STROKE CONTROL STRUCTURE FOR HIGH PRESSURE FUEL PUMP

(75) Inventor: Keith K. Gerlach, Novi, MI (US)

(73) Assignee: Continental Automotive Systems Inc., Auburn Hills, MI (US)

( * ) Notice: Subject to any disclaimer, the term of this patent is extended or adjusted under 35 U.S.C. 154(b) by 1113 days.

(21) Appl. No.: 12/985,736

(22) Filed: Jan. 6, 2011

(65) Prior Publication Data

US 2012/0177505 A1 Jul. 12, 2012

(51) Int. Cl.

| | |
|---|---|
| ***F04B 9/04*** | (2006.01) |
| ***F04B 27/10*** | (2006.01) |
| ***F04B 49/12*** | (2006.01) |
| ***F02M 59/30*** | (2006.01) |

(52) U.S. Cl.

CPC ..... *F04B 27/1072* (2013.01); *F02M 59/30* (2013.01); *F04B 9/04* (2013.01); *F04B 9/042* (2013.01); *F04B 49/12* (2013.01); *F04B 49/126* (2013.01)

(58) Field of Classification Search

CPC F04B 27/1072; F04B 49/126; F04C 14/223; F02M 59/30; F02M 2700/1376; F02D 1/02; Y10T 74/1642; Y02T 10/123

USPC ..... 417/11, 218, 364, 490, 494, 499, 505, 417/561, 470, 471, 313, 415; 123/500, 501, 123/503, 504, 48 B, 78 F; 74/559

See application file for complete search history.

(56) References Cited

U.S. PATENT DOCUMENTS

| | | | | |
|---|---|---|---|---|
| 1,948,047 | A * | 2/1934 | Retel | 417/289 |
| 2,007,197 | A | 7/1935 | Hedblom | |
| 2,099,206 | A * | 11/1937 | Hedblom | 74/833 |
| 2,414,617 | A * | 1/1947 | Summers | F02D 1/02 123/365 |
| 3,386,388 | A * | 6/1968 | Rosenberg | 417/395 |
| 3,417,702 | A * | 12/1968 | Behm | 417/494 |
| 3,545,896 | A * | 12/1970 | Zahradnik | 417/471 |
| 3,698,288 | A | 10/1972 | Sonbe | |
| 3,822,969 | A * | 7/1974 | Kummel | 417/437 |
| 3,958,496 | A * | 5/1976 | Wallin | 91/506 |
| 4,149,830 | A | 4/1979 | Woodruff | |

(Continued)

FOREIGN PATENT DOCUMENTS

| | | | |
|---|---|---|---|
| FR | 1586774 A | | 2/1970 |
| JP | 2004218479 A | * | 8/2004 |
| WO | 9930011 A1 | | 6/1999 |

OTHER PUBLICATIONS

JP 2004218479 A machine translation.*

(Continued)

*Primary Examiner* — Patrick Hamo

(57) ABSTRACT

Control structure controls movement of a high pressure fuel pump piston of a fuel system. The piston is constructed and arranged to be inserted into or withdrawn from a pumping chamber to control a flow of fuel from the pumping chamber. The control structure includes a rocker arm with an associated roller follower. The roller follower is constructed and arranged to engage a camshaft of an engine. The rocker arm is operatively associated with the piston such that movement of the camshaft causes movement of the rocker arm and thus movement of the piston. The control structure also includes actuator structure associated with the rocker arm and constructed and arranged to vary a percentage of camshaft motion imparted to the piston via the rocker arm.

12 Claims, 3 Drawing Sheets

(56) References Cited

U.S. PATENT DOCUMENTS

| | | | | |
|---|---|---|---|---|
| 4,224,916 | A * | 9/1980 | Davis | 123/502 |
| 4,234,292 | A * | 11/1980 | Berg | 417/214 |
| 4,249,499 | A * | 2/1981 | Perr | 123/502 |
| 4,261,307 | A * | 4/1981 | Oldberg | 123/90.15 |
| 4,420,393 | A * | 12/1983 | Smith | 210/101 |
| 4,493,617 | A | 1/1985 | Brady | |
| 4,760,831 | A * | 8/1988 | Altdorf | 123/501 |
| 4,830,589 | A | 5/1989 | Pareja | |
| 5,230,613 | A * | 7/1993 | Hilsbos et al. | 417/439 |
| 7,198,033 | B2 * | 4/2007 | Inaguma | F02D 41/3845 123/198 D |
| 7,409,901 | B2 | 8/2008 | Lucas | |
| 2006/0107914 | A1 * | 5/2006 | Dingle et al. | 123/90.12 |
| 2007/0056552 | A1 * | 3/2007 | Fisher | 123/197.4 |
| 2010/0316506 | A1 * | 12/2010 | Hamilton | F02M 59/102 417/218 |

OTHER PUBLICATIONS

The International Search Report and The Written Opinion of The International Searching Authority.

Examination Report in EP 12701278.9-1604 dated Apr. 7, 2016.

* cited by examiner

VARIABLE STROKE CONTROL STRUCTURE FOR HIGH PRESSURE FUEL PUMP

FIELD

This invention relates to high pressure fuel systems and, more particularly, to control structure for controlling an engine-driven fuel pump in a manner such that noise and fuel pressure pulsations are reduced in the fuel system.

BACKGROUND

In conventional high-pressure fuel systems, an engine-driven fuel pump is a key source of unwanted audible noise as well as a source of fuel pressure pulsations, which complicate the fuel metering task. Management of these pulsations requires 1) extra volume in the fuel rail, which increases the time required to achieve target fuel pressure at engine start, 2) orifices, which increase the pump power consumption, and 3) an increased relief valve set-point, which increases the pressure at which the injectors must open and thus compromises the configuration of the injectors for other targets.

The present state-of-the-art high-pressure fuel pump includes a solenoid and an inlet check valve. To control the volume of fuel pumped, the solenoid holds the electrically-operated inlet check valve open during the beginning of the pumping stroke, then allows the inlet check valve to close at a time during the pumping phase calculated to cause precisely the desired quantity of fuel to be pumped into the fuel rail. This occurs at any fuel demand less than 100% of the pump capability, which is the case nearly 100% of the time during engine operation. Given the practical requirement for an approximately sinusoidal movement of the pump piston, the piston velocity, and therefore the velocity of fuel flowing backward through the inlet check valve before it is allowed to close, is at a maximum just before the valve closes. This high velocity results in slamming of the inlet check valve, a key source of audible noise, and further results in a significant pump-internal fuel pressure spike of hundreds of psi due to reversal of the fuel motion. These fuel pressure spikes result in adverse design requirements for the opening pressure of a required pressure relief valve, the volume of the fuel rail, and the opening pressure of the fuel injectors.

The rapid movement of the solenoid armature between its end stops, one cycle per pumping stroke, is also a significant source of audible noise.

Thus, there is a need to provide control structure for an engine-driven fuel pump that that reduces the audible noise and pressure pulsations, enabling a design choice of reducing the fuel rail volume, enlarging the orifices, and/or reducing the relief valve set-point.

SUMMARY OF THE INVENTION

An object of the invention is to fulfill the need referred to above. In accordance with the principles of the present invention, this objective is achieved by control structure for controlling movement of a high pressure fuel pump piston of a fuel system, preferably for a vehicle. The piston is constructed and arranged to be inserted into or withdrawn from a pumping chamber to control a flow of fuel from the pumping chamber. The control structure includes a rocker arm with an associated roller follower. The roller follower is constructed and arranged to engage a camshaft of an engine. The rocker arm is operatively associated with the piston such that movement of the camshaft causes movement of the rocker arm and thus movement of the piston. The control structure also includes actuator structure associated with the rocker arm and constructed and arranged to vary a percentage of camshaft motion imparted to the piston via the rocker arm.

In accordance with another aspect of an embodiment, a method is provided for controlling movement of a high pressure fuel pump piston of a fuel system. The piston is constructed and arranged to be inserted into or withdrawn from a pumping chamber to control a flow of fuel from the pumping chamber. The method provides a rocker arm with an associated roller follower so that the roller follower engages a camshaft of an engine with the rocker arm being operatively associated with the piston such that movement of the camshaft causes movement of the rocker arm and thus movement of the piston. The rocker arm is controlled to vary a percentage of camshaft motion that is imparted to the piston.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF EXEMPLARY EMBODIMENTS

Figure 1:
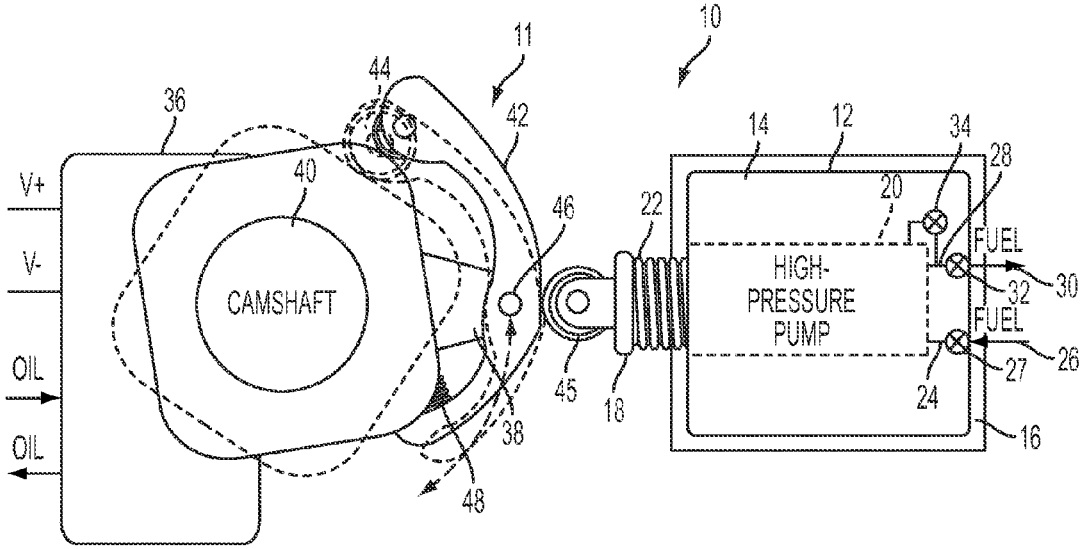
FIG. 1 is a schematic diagram of an engine-driven, variable stroke, high pressure pump system including control structure therefor, provided in accordance with a first embodiment of the invention and shown in a zero stroke control position.

FIG. 1 shows an engine-driven, variable stroke, high pressure pump system, generally indicated at 10, having control structure, generally indicated at 11, provided in accordance with a first embodiment of the invention. The system 10 is employed in gasoline or diesel direct-injection high-pressure fuel supply systems, preferably for vehicles. The system 10 includes a high pressure pump 12 that includes a pump body 14, mounted to the engine cylinder head 16 or camshaft cover over an opening (not shown), with a typical oil seal (not shown) provided for the opening. An axially movable piston 18 is disposed within a pumping chamber 20 of the pump body 14. A spring 22 forces the piston 18 toward its utmost withdrawn position from the pumping chamber 20. An inlet connection 24 is provided between the pumping chamber 20 and a low pressure fuel supply 26. A preferably hydraulically operated inlet check valve 27 allows flow of fuel from the supply 26 to the pumping chamber 20, but prevents fuel flow in the opposite direction. The inlet check valve 27 can be solenoid operated to hold the inlet check valve 27 open in systems that need to reach zero pump flow rapidly, but not to be operated at every pump stroke. An outlet connection 28 is provided between the pumping chamber 20 and a high pressure fuel outlet 30 that can be connected to a fuel consumer, such as a high pressure fuel rail. An outlet check valve 32 allows fuel flow from the pumping chamber 20 to the consumer, but prevents flow in the opposite direction. A pressure relief valve 34 allows fuel flow from the high pressure fuel outlet 30 back to the pumping chamber 20 when the pressure at the high pressure fuel outlet exceeds the pressure in the pumping chamber by a specified amount.

The system 10 includes a stroke control actuator structure 36, which can be electric only, electro-hydraulically, or hydraulically operated. For example, the actuator structure 36 can be a stepper motor, DC motor, similar to those used for throttle control, reduction gears, worm gears, a direct solenoid, hydraulically controlled with oil control solenoid valves similar to those used for camshaft phase control, hydraulically controlled by the fuel pressure in the fuel rail, or other control structure. The actuator structure 36 controls the position of a moveable control element 38 along a required path, between two endpoints, in response to control inputs (e.g., shown as electrical inputs V+ and V−), as explained more fully below. The control element 38 can be considered to be part of the actuator structure 36.

If actuation is purely electrical, the control element 38 may default to a specified "limp home" position when electrical current is zero. If actuation is electro-hydraulic, the control element 38 may default to two different specified "limp home" positions when electrical current is zero, depending upon whether or not normal oil supply pressure is available.

The control structure 11 preferably includes a rocker arm 42 with associated roller follower 44 that provides a low-friction interface with a camshaft 40 of an engine. For a typical high-pressure direct injection engine, the number of lobes of the camshaft 40 is such that one pump stroke will occur for each cylinder combustion event. As the camshaft 40 turns, the rocker arm 42 with follower 44 moves according to the profile of the camshaft 40. The rocker arm 42 directly or indirectly imparts its motion to the piston 18 of the pump 12, preferably via roller follower 45 due to the arc motion of the rocker arm 42. The percentage of camshaft 40 motion that is imparted to the piston 18 via the rocker arm 42 varies depending solely upon the position of the support pivot 46 coupling the rocker arm 42 to the moveable control element 38. The support pivot 46 follows an arc-shaped path between two endpoints to provide the desired pump piston stroke, with a variable withdrawing piston position and preferably a constant inserting piston position, with respect to the pump housing 14. The rocker arm 42 will experience some amount of "lost motion" which is not imparted to the piston 18 of the pump 12 when controlled for less than 100% pump stroke.

A spring 48 biases the rocker arm 42 to ensure the roller follower 44 will always be in contact with the camshaft 40, even at the zero stroke control position when the spring 22 associated with the pump 12 is not contributing force. Though a coil spring is shown, leaf, helical, or other spring configurations may be used.

Figure 2:
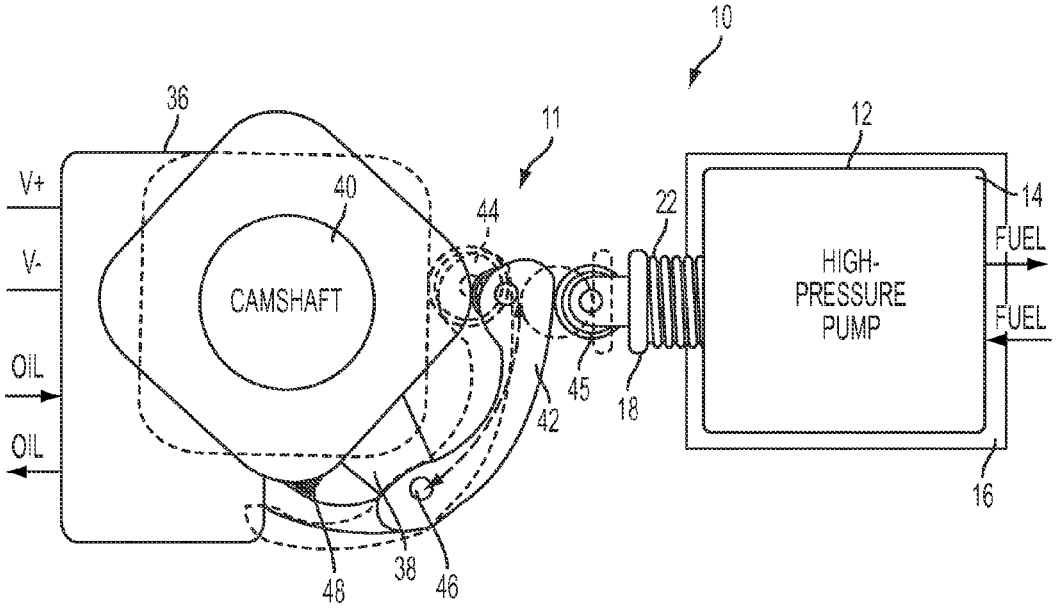
FIG. 2 is a view of the system of FIG. 1, shown in a 100% stroke control position.

The system 10 is shown in FIG. 1 in a zero pump stroke position, while FIG. 2 shows the system in a 100% pump stroke position.

With reference to FIGS. 1 and 2, the moveable control element 38 rotates about the same axis as the camshaft 40. As such, the timing of the pump stroke is earlier or later, relative to movement of the camshaft 40, depending upon the control position. The amount of timing variation is proportional to the length (in camshaft degrees) of the arc from the support location 46 of the rocker arm 42 to the opposite extreme contact point of pump roller follower 45 on the rocker arm (equal to the allowed range of motion of the moveable control element 38, in camshaft degrees). The rocker arm 42 can be oriented around the camshaft 40 in such a way that the pump stroke occurs earlier when the pump stroke is larger (and therefore occurs later when the pump stroke is smaller) to complement the variation of fuel injection timing, since injection pulses typically begin earlier when the quantity of fuel to be injected is greater. In the embodiment of FIGS. 1 and 2, the spring 48 moves in conjunction with the moveable control element 38.

Figure 3:
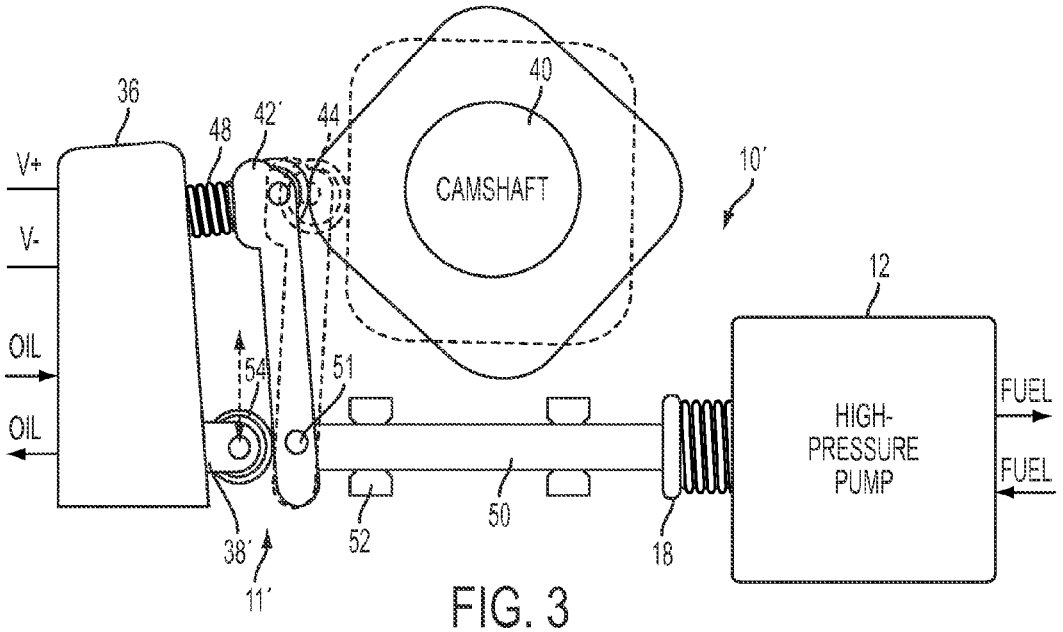
FIG. 3 is a schematic diagram of an engine-driven, variable stroke, high pressure pump system including control structure therefor, provided in accordance with a second embodiment of the invention and shown in a zero stroke control position.
Figure 4:
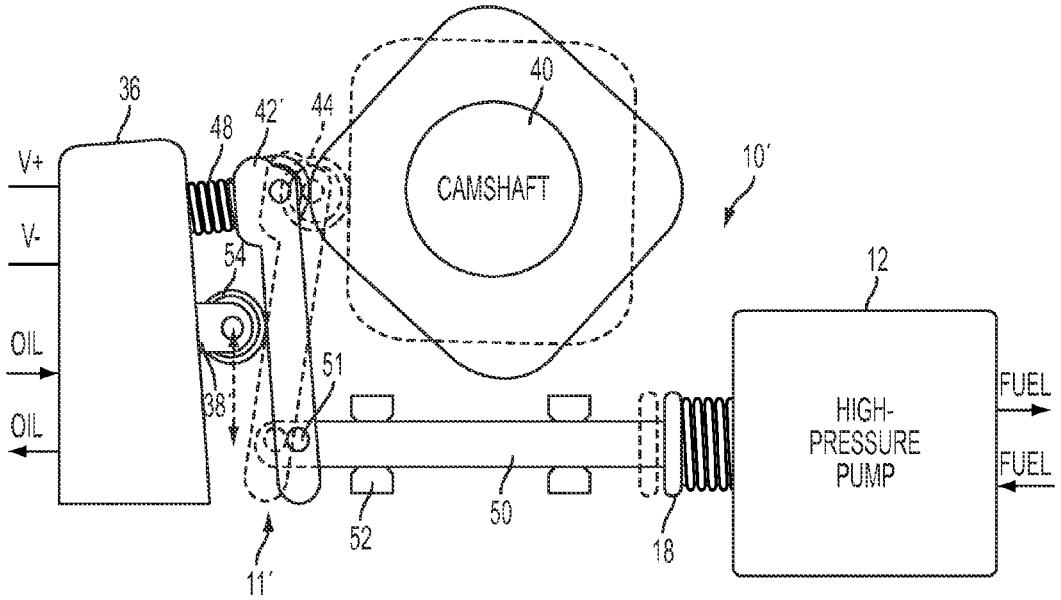
FIG. 4 is a view of the system of FIG. 3, shown in a 100% stroke control position.

FIGS. 3 and 4 show an engine-driven, variable stroke, high pressure pump system, generally indicated at 10', with the control structure, generally indicated at 11', provided in accordance with a second embodiment. FIG. 3 shows the system 10' in the zero pump stroke position and FIG. 4 shows the system 10' in the 100% pump stroke position.

In addition to the parts common to FIG. 1, in the embodiment of FIGS. 3 and 4, the control structure 11' includes a pushrod 50 coupled with the piston 18 and coupled via a hinge connection 51 to the rocker arm 42'. The pushrod 50 is supported by guides/bushings 52 that provide the vertical location control for the rocker arm 42'. The pushrod 50 transmits all forces between the rocker arm 42' and the piston 18 of the pump 12. The pump stroke timing is not affected by the control position. Since the motion of the pushrod 50 is purely linear, the roller follower 45 (of FIG. 1) can be eliminated. However, a roller follower 54 may be required on the moveable control element 38' as shown. The moveable control element 38' is not attached to the rocker arm 42', but moves generally linearly to provide a fulcrum for rotation of the rocker arm 42' about the hinge connection 51. The spring 48 is fixed to the cylinder head and does not move in conjunction with the moveable control element 38'.

Figure 5:
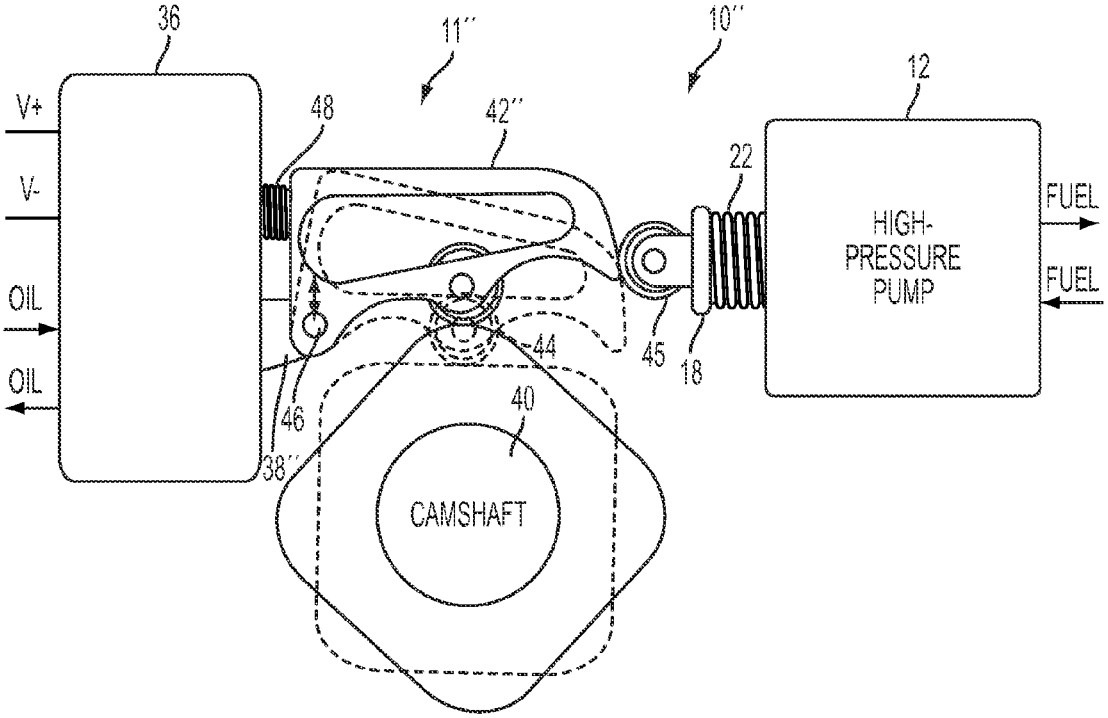
FIG. 5 is a schematic diagram of an engine-driven, variable stroke, high pressure pump system including control structure therefor, provided in accordance with a third embodiment of the invention and shown in a zero stroke control position.
Figure 6:
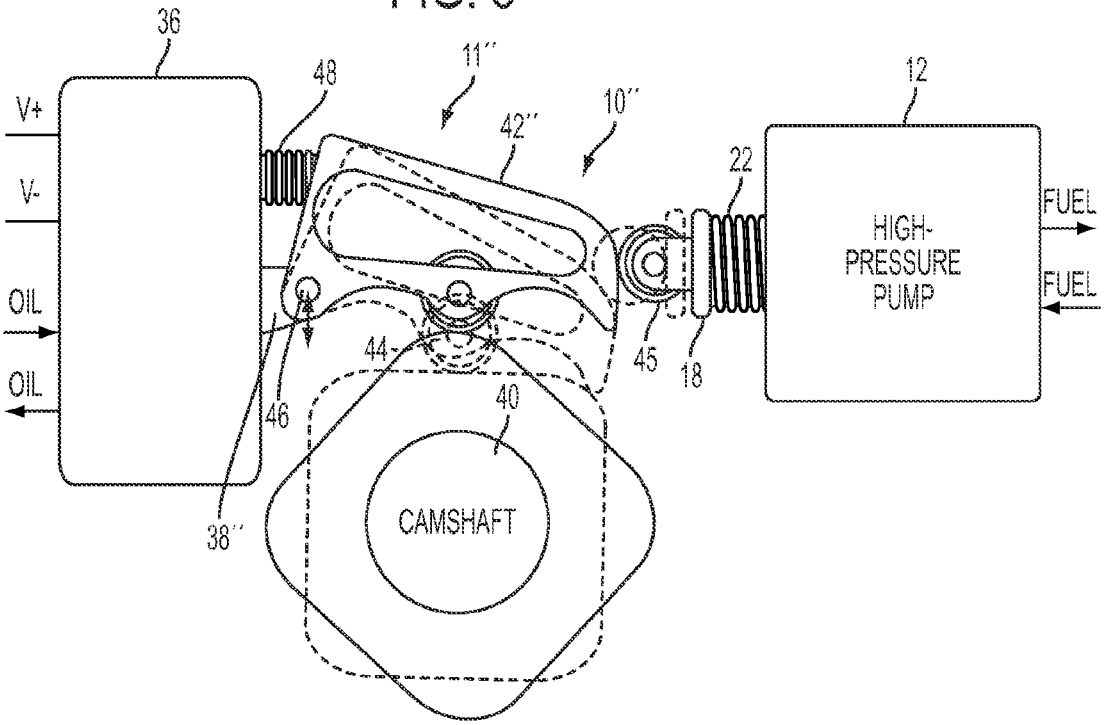
FIG. 6 is a view of the system of FIG. 5, shown in a 100% stroke control position.

FIGS. 5 and 6 show an engine-driven, variable stroke, high pressure pump system, generally indicated at 10", including control structure, generally indicated at 11", provided in accordance with a third embodiment. FIG. 5 shows the system 10" in the zero pump stroke position and FIG. 6 shows the system 10" in the 100% pump stroke position.

In the embodiment of FIGS. 5 and 6, due to the specific contour of the control structure 11" including the rocker arm 42", the capability for shorter duration pump strokes is provided. Therefore, more consistent piston speeds occur during the piston stroke. Rather than simply transmitting a percentage of the camshaft lift to the piston 18 of the pump 12 (with proportionally reduced piston speeds), this embodiment controls the camshaft angle at which the piston 18 begins withdrawing from the pumping chamber 20 (seen in FIG. 1). The stroke timing is symmetrical about the minimum camshaft lift point, so a stroke that begins later is shorter in both displacement and duration. The spring 48 moves in conjunction with the moveable control element 38", which moves generally linearly. The control element 38" is coupled to the rocker arm 42" at the support pivot 46.

It is noted that in the Figures, the rocker arm 42, 42', 42", camshaft 40, and other affected parts are shown solid at the position corresponding to maximum camshaft lift, and are shown dashed at the position corresponding to minimum camshaft lift.

Thus, the embodiments use control structure 11, 11' 11" provided between the engine camshaft 40 and the pump 12 that varies the amount of displacement transferred from the camshaft 40 to the pump piston 18, according to the fuel demand. The control structure 11, including the variable rocker arm 42, modulates the pump stroke, so that no other device is required to modulate the fuel quantity pumped. For example, at a fuel demand equal to 50% of the pump capacity, the piston stroke will be controlled to approximately 50% of maximum, modulated to achieve the target fuel pressure in the fuel rail. For optimum pumping efficiency, the stroke control structure should leave the unswept volume of the pumping chamber relatively unchanged regardless of stroke (e.g., only the distance the piston is withdrawn from the pump body should be affected). During periods of zero fuel injection demand, and when a failure eliminates the fuel supply to the pump 12, the piston stroke will be controlled to zero, completely eliminating concerns regarding piston overheating and pump failure during these modes.

The moving parts of the control structure 11, 11' 11" can be completely contained within the engine cylinder head, be lubricated with engine oil, and be configured to operate with continuous, linear loads. Thus, no impacts occur that could result in objectionable noise. The control structure can be chosen from among a large variety of available configurations for achieving variable engine valve lift, but can be cost-reduced due to the much less severe loading conditions and less strict tolerances required for driving the fuel pump.

The embodiments can completely eliminate the conventional fuel pump solenoid and, thus, eliminates the solenoid noise from the pump 12. The inlet check valve 27 is allowed to always act purely hydraulically, and therefore always closes at a similar low fuel velocity early in the pumping stroke, with low noise and less or no pressure pulsations resulting. Thus, audible noise and the pulsations are reduced or eliminated, thereby allowing elimination of noise mitigation parts, reduction of fuel rail volume, and reduction of the time required to achieve target fuel pressure at engine start. By reducing or eliminating the pressure pulsations, the embodiments also allow for the reduction of the required opening pressure for the pressure relief valve 34, which in turn allows reduction of the maximum pressure at which the fuel injectors are required to open, which in turn may allow improvement of the injector working flow range. In the same manner, the embodiments can also increase the diameter of the flow restriction orifice typically provided between the fuel pump and the fuel rail, such that the amplitude of pressure pulsations at the injectors is unchanged, but the required pump mechanical power consumption is reduced.

The use of lost-motion rocker arms as the control structure 11, 11', 11" is compatible with existing pump and multi-lobe camshaft designs, and preserves the capability for one pump stroke per fuel injection event, with synchronized timing. The embodiments improve the durability of the pump 12 due to the reduced average piston speed, reduced average pressure on the piston during the pumping phase, and reduced internal pressure pulsations. The present state-of-the art fuel pump relies on fuel flow to keep its piston from overheating and failing, which could occur during long periods of zero fuel injection demand, or even during very short periods of zero fuel supply due to a failure. The embodiments eliminate this reliance on fuel flow and therefore completely eliminate these durability concerns.

Further features of the embodiments are:

- Elimination of noise and pulsations, and improvements during zero fuel flow, compared to on/off control of the inlet check valve flow, as detailed above
- Elimination of cavitation during the suction phase, and therefore elimination of the need for an expensive flexible diaphragm to seal the piston to the pump body, compared to linear throttling of the inlet check valve flow
- Lower weight and cost compared to either electric drive or any type of continuously-variable transmission (CVT)
- Faster pressure control response time compared to any type of CVT
- Pump strokes remain synchronized with each fuel injection event, compared to electric drive, CVT, eccentric element, or skipping strokes
- More flexible and compact packaging compared to variable-angle swash plate
- Makes use of existing proven high-volume engine valve train design concepts.

Thus, the embodiments provide a variable stroke system compatible with engine driven piston pumps and existing multi-lobe camshaft configurations, to obtain all of the functional benefits described above.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the scope of the following claims.

What is claimed is:

1. Control structure for controlling movement of a high pressure fuel pump piston of a fuel system, the piston being constructed and arranged to be inserted into or withdrawn from a pumping chamber to control a flow of fuel from the pumping chamber, the control structure comprising:

a rocker arm with an associated roller follower, the roller follower being constructed and arranged to directly engage a camshaft of an engine, with the roller follower being between the rocker arm and the camshaft, the rocker arm being operatively associated with the piston such that movement of the camshaft causes movement of the rocker arm and thus movement of the piston, and actuator structure associated with the rocker arm and including a control element mechanically engaged with the rocker arm and movable along a path between two endpoints in response to an input to the actuator structure so as to vary a percentage of the camshaft motion imparted to the piston via the rocker arm, according to fuel demand, wherein the control element and camshaft rotate about a common axis and the control element is coupled to the rocker arm via a support pivot, and wherein the path is an arc-shaped path.

2. The control structure of claim 1, wherein the actuator structure and rocker arm are constructed and arranged such that a timing of a stroke of withdrawing the piston from the pumping chamber is variable.

3. The control structure of claim 1, wherein the input is electrical current input to the actuator structure.

4. The control structure of claim 3, wherein the actuator structure is constructed and arranged to also be hydraulically operated in the event that electrical current is not available.

5. The control structure of claim 1, wherein the input is hydraulic pressure input to the actuator structure.

6. The control structure of claim 1, in combination with a fuel pump having the piston, wherein a second roller follower is provided between the rocker arm and the piston.

7. The control structure of claim 1, further comprising a spring biasing the rocker arm so that the roller follower will engage the camshaft, wherein the spring moves in conjunction with the control element.

8. The control structure of claim 1, in combination with a fuel pump, the fuel pump including a hydraulically operated inlet check valve.

9. The control structure of claim 1, in combination with a fuel pump, the fuel pump including a solenoid operated inlet check valve constructed and arranged to remain open to reach zero pump flow rapidly, but not constructed and arranged to be operated at every pump stroke.

10. A method of controlling movement of a high pressure fuel pump piston of a fuel system, the piston being constructed and arranged to be inserted into or withdrawn from a pumping chamber to control a flow of fuel from the pumping chamber, the method comprising:

providing a rocker arm with an associated roller follower so that the roller follower directly engages a camshaft of an engine, with the roller follower being between the rocker arm and the camshaft, the rocker arm being operatively associated with the piston such that movement of the camshaft causes movement of the rocker arm and thus movement of the piston, and controlling the rocker arm to vary a percentage of camshaft motion that is imparted to the piston via the rocker arm, according to fuel demand, wherein the step of controlling the rocker arm includes:

providing an actuator structure including a control element mechanically engaged with the rocker arm and movable along a path between two endpoints in response to an input to the actuator structure, wherein the method ensures that the control element and camshaft rotate about a common axis and the control element is coupled to the rocker arm via a support pivot, and wherein the path is an arc-shaped path and a spring biases the rocker arm so that the roller follower will engage the camshaft, with the spring moving in conjunction with the control element.

11. The method of claim 10, wherein the step of controlling the rocker arm includes varying a timing of a stroke of withdrawing the piston from the pumping chamber.

12. The method of claim 10, wherein the control element is movable in response to electrical and/or hydraulic input to the actuating structure.

* * * * *